United States Patent [19]

Kern

[11] Patent Number: 4,802,576

[45] Date of Patent: Feb. 7, 1989

[54] STORAGE CONTAINER FOR A PAINT ROLLER

[76] Inventor: Ingo Kern, Witzlebenstrasse 13, D-1000 Berlin 19, Fed. Rep. of Germany

[21] Appl. No.: 935,327

[22] Filed: Nov. 26, 1986

[30] Foreign Application Priority Data

Nov. 26, 1985 [DE] Fed. Rep. of Germany ..... 3542164

[51] Int. Cl.[4] ..... B65D 43/16; B65D 85/08

[52] U.S. Cl. ..... 206/225; 15/257.06; 206/229; 206/361

[58] Field of Search ..... 15/104 R, 257.06; 206/207, 209, 225, 229, 361, 575, 45.31; 220/4 E, 344, 378; 229/175

[56] References Cited

U.S. PATENT DOCUMENTS

| | | | |
|---|---|---|---|
| 1,595,965 | 8/1926 | Johnson | 15/104 R |
| 2,622,728 | 1/1949 | Liebermann . | |
| 2,936,878 | 5/1960 | Claude | 206/209 |
| 3,295,713 | 1/1967 | Optner | 220/4 E |
| 3,432,380 | 3/1969 | Weber | 206/45.31 |
| 4,031,312 | 6/1977 | Coleman et al. | 220/344 |
| 4,262,835 | 4/1981 | Wrobel . | |
| 4,361,226 | 11/1982 | Travis | 206/45.31 |
| 4,445,250 | 5/1984 | Seidl | 15/257.06 |
| 4,547,926 | 10/1985 | Kern | 15/257.06 |
| 4,549,562 | 10/1985 | Ossi | 15/257.06 |

FOREIGN PATENT DOCUMENTS

| | | | |
|---|---|---|---|
| 1691138 | 1/1955 | Fed. Rep. of Germany . | |
| 2259245 | 6/1977 | Fed. Rep. of Germany . | |
| 2550733 | 2/1985 | France | 206/229 |

*Primary Examiner*—Jimmy G. Foster

*Attorney, Agent, or Firm*—Spencer & Frank

[57] ABSTRACT

A storage container for a paint roller including a paint applying roll and a handle, the paint roller storage container surrounding the roller on all sides and having a housing provided with a recess for the paint roller, wherein a further recess for a roll of foil is provided next to the paint-applying roll within or outside of the container, the foil recess extending parallel to the paint-applying roll. When the inventive container is closed, it hermetically seals the paint-applying roll.

19 Claims, 1 Drawing Sheet

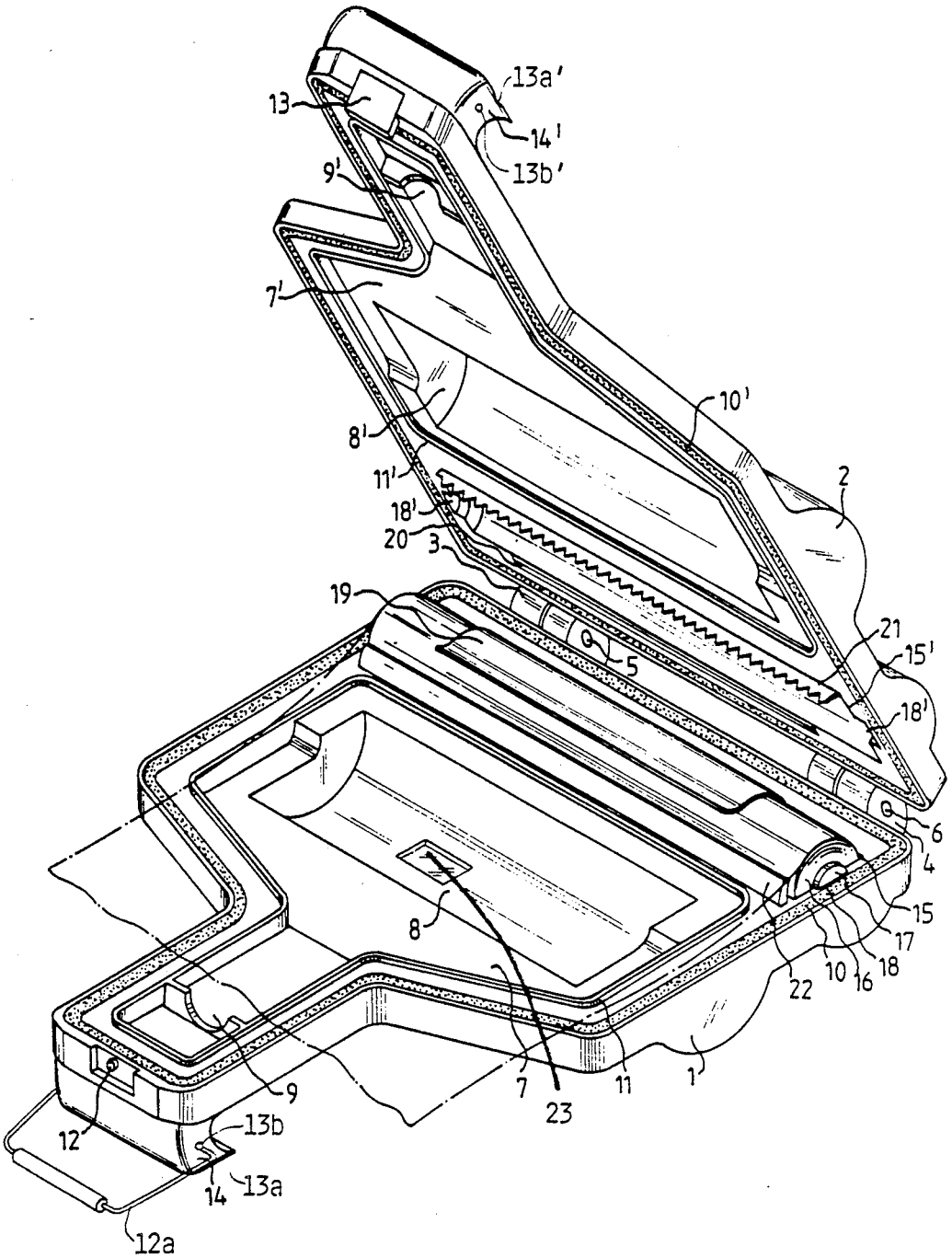
13a'
13
14'
13b'
9'
7'
10'
8'
11'
2
18'
20
3
19
21
15'
5
18'
6
4
8
15
17
10
16
18
22
9
7
23
11
1
12
13b
14
13a
12a

STORAGE CONTAINER FOR A PAINT ROLLER

BACKGROUND OF THE INVENTION

1. Field of the Invention

The present invention relates to a storage container for a paint roller including a paint applying roll which encloses the paint roller on all sides.

2. Description of the Background

A storage container for a paint brush is disclosed in German Pat. No. 3,306,181. This container has the drawback that since it is intended for containing a solvent which absorbs paint adhering to a a paint applying device, it becomes soiled after being used only one time and must be replaced.

Moreover, this prior art container is hardly suitable to accommodate paint rollers since the amount of solvent necessary to absorb the paint from a paint roller is unsuitably large. It is moreover undesirable that the paint-applying roll be impregnated with a solvent when it is taken up again for use. Clearly, in such a situation the solvent has to be initially removed which definitely complicates and unnecessarily prolongs the operation.

SUMMARY OF THE INVENTION

It is an object of the present invention to provide a storage container of the above-mentioned type in which, on one hand, the paint-applying roll can be stored without being previously cleaned, and on the other hand the paint-applying roll can be used after storage without additional cleaning manipulations.

The novel paint roller storage container is a storage container for a paint roller having a handle and a paint-applying roll, said storage container having a housing enclosing said paint roller on all sides, and provided with a recess to position the paint roller, an inside and an outside, and open and closed positions, wherein the open position permits the insertion and removal of the paint roll, the improvement comprising a seal provided in said container which becomes hermetic when the container is in the closed position; and the housing is further provided with a further recess serving as a receptacle for a roll of foil, said further recess being adjacent the paint-applying roll and extending parallel thereto.

A more complete appreciation of the invention and many of the attendant advantages thereof will be readily perceived as the same becomes better understood by reference to the following detailed description when considered in connection with the accompanying figures.

BRIEF DESCRIPTION OF THE DRAWING

The FIGURE is a perspective view of an open container according to one embodiment of the invention.

Other objects, advantages and features of the present invention will become apparent to those skilled in the art from the following discussion.

DESCRIPTION OF THE PREFERRED EMBODIMENTS

The invention is based on the realization that it is possible to wrap in a foil the part of the paint-applying device which comes into contact with the paint. The foil used for wrapping the device is impermeable to the paint or to solvents. This makes it, therefore, possible to prevent the soiling with paint of the interior of the storage container. Consequently, the paint roller is readily available for new use in a short period of time.

A container surrounding the paint-applying device and the foil in an air-tight manner additionally prevents the drying of the paint, therefore doing away with all previous requirements for special solvents.

In the past, solvents were used to exclude air from the area in contact with the paint and also to prevent the soiling of the container. The paint which was expelled from the paint carrier had then to be discarded together with the solvent.

The above arrangement provides the particularly useful advantage that no supply of solvent need now be additionally provided for use with the container. Rather, the roll of foil provides sufficient material for the repeated use of the container.

In the present invention, the throw-away foil provided in a roll serves to prevent the soiling of the interior of the paint roller container whereas the storage container itself provides the air-tight seal which prevents the drying of the paint in situ.

The roll of foil is provided in the form of customary household rolls. However, the foil is advisably supplied in a width adapted to the length of the paint roller and its use is, therefore, extremely economical.

The plastic foil can often be produced from less material than the corresponding required amount of solvent. This renders the invention extremely advantageous in terms of cost and convenience. In addition, the plastic foil can be discarded without damaging the environment. Thus, the invention provides an unexpected advantageous solution which is also preferable for ecological reasons.

In a preferred embodiment of the invention, the paint roller storage container is constructed of two shaped parts with a hinge-like connection being provided to join the two shaped parts. The joining of the two parts is attained in an articulated manner so as to enclose at least the paint-applying roll in an air-tight fashion.

The paint roller storage container is preferably composed to two symmetrical parts, each part having one side in the form of a trough. The parts of the paint roller storage container are preferably produced by injection molding or as deep-drawn pieces.

An air-tight seal around the edges of the housing parts can be added. This air-tight seal is most favorably composed of a rubber ring inserted into a corresponding recess. The air-tight seal may also be applied to the edge regions in the form of an appropriate coating. In a preferred embodiment, this coating may be formed of a porous, elastic plastic material.

There are further favorable features to the invention which are described hereinbelow. The two parts comprising the paint roller storage container are made substantially identical and are provided with a correspondingly symmetrical configuration. Thus, in an embodiment where the two parts of the paint roller storage container are formed into one piece, one of the parts constitutes the bottom member onto which the correspondingly configured cover member is placed by folding it about 180°.

All engaging elements are designed in a manner such that the regions disposed on one side of an imaginary line of symmetry going through the paint roller storage container form recesses into which engage corresponding raised regions on the other side of the line of symmetry when the two parts of the storage container are superimposed and the container is closed. In this way, tooling costs are also kept to a minimum.

Slight deviations may exist from the symmetry between the bottom and the cover members which for functional reasons cannot be made to coincide. These variations are either produced by subsequent working or by giving the respective injection molding tool or mold a variable configuration.

A spring clamp is rotatably mounted onto one of the parts of the two-part housing at a position opposite the side where the hinge members reside in the paint roller storage container. For closing, this spring clamp resiliently catches an element provided on the opposite part which when two parts are superimposed in the closed position is positioned along the axis of the clamp.

In another preferred embodiment, the hollow inner contour of the container accommodates the handle of the paint roller. The recess is configured in a way such that a one-sided carrying arm for the paint roller can be placed into the container in either one of the two possible positions.

The paint roller storage container is preferably provided with a further recess in the part facing the outside. This recess forms a handle which can be gripped by a hand so that the container can be carried with ease.

The container is also favorably provided with molded-on supporting feet on at least one of its parts. These supporting feet provided on the paint roller storage container permit the open container to rest on a planar support. These supporting feet may also be formed by a handle member molded onto the container.

Another feature provided by the invention is a tear edge. This tear edge is provided between the space provided to accommodate the roll of foil and the adjacent region capable of accommodating the paint-applying roll. This tear edge may be a serration edge or a cutting edge and it preferably interacts with an edge or web provided on the opposite housing member so that, when the housing is closed, the foil is severed at this edge.

As a further feature of the invention, short shaft stumps are molded or are insertable in the area provided to accommodate the roll of foil. The stumps extend into the interior of the roll of foil so as to axially rotatably support it.

An abutment or marker is disposed on the other side of the receptable of the foil roll from the side where the cutting edge is located, and at a distance corresponding to the circumference of the receptacle for the paint roller so that an amount of foil sufficient to enclose the paint roller has been unrolled from the roll when this abutment is reached.

In a preferred embodiment of the novel paint roller storage container, the roll of foil provides a single layer of foil. However, the roll of foil may also be wound with a fold on one side. Useful are foils employed for home use or for the production of bags by means of foil sealing devices.

In another preferred embodiment of the novel paint roller storage container, the roll of foil may also be composed of contiguous, complete bags which are open on one side. The width of the recess for the roll of foil and the width of the roll of foil, both exceed the width of the recess for the paint-applying roll so that the sides of the latter can also be wrapped.

For the use of the single layer of plastic foil, a certain length is unwound which is required to completely enclose the paint-applying roll on both sides. Thus, the paint roll is wrapped underneath and the foil is then folded over onto the top.

In contradistinction thereof, one-half of the same length of plastic foil is sufficient if the foil is supplied as a double layer. In the latter case, the closed upper and lower members of the housing not only cut off the plastic foil but, in addition, exert a linear pressure on both sides along the paint roller to keep the foil closed around the paint-applying roll.

The paint roller storage container is preferably suited to accommodate a lamb's wool roll or a nylon roll saturated with paint, and has a bar and handle and a width of about 25 cm. However, other size paint rolls are also contemplated within the scope of this invention.

By wrapping the paint roller in a plastic foil and sealing the container in an air-tight manner, premature drying of the paint is substantially prevented. Thus, with the novel paint roller storage container it is no longer necessary to wash out the paint before re-using the paint roller the next day as was required in the past.

The paint roller storage container according tothe invention is capable of preventing the drying of the paint in the lamb's wool of nylon paint roll for at least 20 hours.

The plastic foil surrounding the paint-applying roll is preferably at least substantially pre-severed by the serrated edge described above. When the upper cover is closed after the paint roller has been placed into the container either from the right or from the left, the serrated edge can act on the foil.

The storage container for the wet paint roller is preferably composed of hard PVC and has a color such as hue RAL 6018. However, other materials and colors are also contemplated within the scope of the invention.

In a preferred embodiment of the invention, the novel paint roller storage container includes two symmetrical halves which are articulate to one another by means of two hinges positioned on the two parts on the side closer to the roll.

A rubber O-ring is disposed in a channel provided in the lower half or part of the paint roller storage container so as to produce an air-tight seal when the container is closed.

The closure of the storage container is composed of a metal bar shaped for this purpose and mounted on a movable shaft at the handle end in the upper cover or part of the storage container in a holder provided for this purpose. The closing of the paint roller container is effected by pressing this bar over a projecting plastic edge positioned at the handle end of the lower cover or part of the storage container after the container halves have been pressed together.

A device to support the roll of plastic foil is provided on the side of the storage container opposite the handle. The plastic foil is braked in this position by at least one spring clamp.

The foil is pulled out towards the handle end in order to wrap the paint-applying roll. The paint-applying roll is then placed in the recess provided in the lower container half. The foil is folded thereafter around the paint-applying roll and the upper cover is placed on top of the lower cover of the paint roller storage container and then locked closed in an air-tight manner.

By the time the upper cover of the storage container is closed, the plastic foil has already been substantially or completely severed from the roll by means of the already described serrated edge.

When the paint roller needs to be reused, the paint-applying roll wrapped in the plastic foil can easily be removed from the paint roller storage container by simply opening the container.

Other advantageous modifications of the invention are described in greater detail in the text hereinbelow in connection with the description of the drawing which depicts one of the most preferred embodiments of the invention.

The embodiment of the paint roller storage container accommodating a paint applying device shown in the drawing figure is composed of a bottom part or member 1 and a cover part or member 2. These two parts essentially coincide in configuration. In the particular embodiment where the two parts are made of plastic they may be originated by a single injection mold.

The two parts comprising the paint roller storage container may be manufactured in succession and be subjected to only slight post-manufacturing changes at most. The two parts of the housing of the paint roller storage container are configured as half-shell type hollow bodies, and are preferably manufactured by injection molding or by a deep drawing process.

In another preferred variation of the above embodiment, the bottom member 1 and the cover member 2 are provided with an elongated shape and are simultaneously manufactured by means of a single mold. In the case of this variation, the connection provided between the two parts of the paint roller storage container is made by means of flexible molded or otherwise shaped flexible "film hinges" provided for in the mold.

In the embodiment shown in the drawing figure, two two-part hinges 3 and 4 are provided to connect the two parts 1 and 2. The hinge members are attached onto the two parts of the paint roller storage container in a manner such that the corresponding positions of the identically configured bottom and cover members are made to coincide. The bottom and cover members of the housing therefore have the same configuration also in this respect. To join the two parts 1 and 2, a metal shaft 5 or 6, respectively, is inserted into the hinges 3 and 4.

The bottom member of the paint roller storage container is provided with a first recess region 7 into which a paint roller can be placed, a semi-cylindrical recess 8 which serves in particular to accommodate the paint-applying roll, and a further recess 9 serving to accommodate the handle. Recess 9 provided to accommodate the handle of the paint roller in the storage container is adapted to standard handle dimensions.

The free space within recess 7 is, moreover, also given standard dimensions. The dimensions of the paint roller storage container are such that the connection between the axis of the paint-applying roll to be placed in this recess and its handle, can be introduced into the storage container independently of the orientation of the paint roller.

This is the case even for the paint rollers wherein the connection between the roller and the handle is provided only on one side. The above-mentioned recesses are also provided in the cover member 2 of the paint roller storage container and are therein marked 7' to 9'.

The bottom and/or cover members of the paint roller storage container are provided along their respective edges with respective gaskets 10 or 10'. These gaskets are made of an elastic material. The elastic material of which the gaskets are made may either be a rubber gasket which is placed into a corresponding recess or may be applied by a special process in the form of an elastic foamed substance. When the paint roller storage container is in the closed position, the two gaskets 10 and 10' provide an air-tight seal against the environment.

Further edges 11 or 11' are provided respectively around recesses 7, 7' accommodating the paint-applying roll to seal the interior of the recesses 7, 7'. This extra sealing capability afforded the paint roller storage container provides additional protection against escaping paint. However, this seal need not be an air-tight seal.

The upper and lower members of the housing further include a closing mechanism composed of a recess equipped with a pin 12 located on the lower member 1 of the container and an elastic bar 13 molded onto the cover member 2 of the container. The elastic bar 13 is passed over the pin 12 upon closing to provide a safety device against inadvertently opening the container.

If the upper and lower members of the paint roller storage container have identical configurations, a rotatable closure bar **12*a* in the form of a spring or a snap can be provided in addition to or instead of bar 13. This bar 12*a* is mounted onto one of the parts of the paint roller storage container to be rotatable on shaft stubs in bores 13*b*** and passes over the corresponding location of the opposite member of the storage container when the latter is in the closed state.

The closure bar **12*a* is composed of spring steel wire and its ends are inserted into openings or bores 13*b*. The closure bar 12*a* snaps into a recess 13*a'*. The bottom and cover members of the paint roller storage container are also substantially identical with respect to bores 13*b* and 13*b'* and recesses 13*a* and 13*a'*** for the bar so that the bar can be attached to either one of the two members of the storage container.

Two carrying handles 14 and 14' are provided in the paint roller storage container in the form of raised portions in the vicinity of recesses 9 and 9' for the handle of the paint roller. The two carrying handles simultaneously accommodate the closing means and serve as gripping means for closing, opening and carrying the paint roller storage container.

In parallel orientation to and adjacent to the recesses 8 or 8' for the paint-applying roll of the paint roller storage device there are further semi-cylindrical recesses 15 and 15', respectively. In the drawing provided herein, the recess 15 cannot be seen since it is covered with a roll of foil 16. The length in the axial direction of the recesses 15 and 15' exceeds the corresponding length of the recesses 8 and 8', respectively.

A roll of polyethylene foil 16 can be inserted into recess 15 or 15'. The inserted roll of polyethylene foil 16 can be engaged by means of a shaft member 17 in additional recesses 18 and 18' so that the roll can be guided during unwinding.

The shaft member 17 is provided to fit in the recess 18 and may have the shape of a continuous hollow roller. The shaft member 17 may also be configured as two shaft stumps which are inserted into the sides of the roll of polyethylene foil.

A spring face 19 is provided in the region of recess 15 for the roll of plastic foil in the bottom member 1 of the paint roller storage container. This spring serves as a brake to any inadvertent unrolling of foil from the roll 16. Spring face 19 is inserted into a recess provided in the bottom member of the paint roller storage container which is not visible in the drawing. If the bottom and top members of the paint roller storage container have identical configurations, this recess is also provided in the latter member as recess 20.

A serrated edge 21 is provided at the edge of the recess 15' which is adjacent the recess 8' located in the upper member 2 of the paint roller storage container. This serrated edge 21 is composed of a row of teeth, each of the teeth having a length of about 7 mm. The serrated edge 21 is stamped out of a spring metal sheet and is inserted into a corresponding recess within the upper member 2 of the paint roller storage container.

A web or edge 22 is inserted into the corresponding recess in the bottom member 1 of the paint roller storage container to serve as a supporting face for the cutting edge severing the unrolled polyethylene material. When the container is closed, the teeth of the serrated edge 21 penetrate the foil tensioned by web or edge 22 and sever the foil.

An alternative possibility to providing the paint roller storage container with a serrated edge for severing the plastic foil, is to provide the paint roller storage device instead with a spatula or putty knife. The spatual or putty knife are provided at the wed or edge 22 of the container which serves as a supporting edge.

The function of the paint roller storage container is to unroll the plastic foil to approximately the position shown in the drawing before the paint roller is placed in it. This position is marked by the placement of a web or edge 9 and is sufficient to wrap the unrolled foil around the paint-applying roll when the roll is placed into the recess 8 of the paint roller storage container.

The width of the recesses 15 and 15' for the roll of polyethylene foil must exceed the width of the recesses 8 and 8' for the paint-applying roll in the housing. It is this feature which permits that the plastic foil also be placed around the sides of the paint roll when the paint roller is positioned in the storage container so that the latter is completely enclosed in the plastic foil. This arrangement completely avoids the soiling of the container and the loss of paint.

The air-tightness of the closed container additionally prevents the drying of the paint so that the paint roller can be removed from the container ready for use even after a prolonged interruption.

A plastic foil wrapped as a double layer similar to the ones used in foil sealing devices can also be used in a favorable manner instead of a simple foil. A roll of plastic foil which contains contiguous bags which are open on the side can also be used. In these embodiments, the paint roller must then be inserted into the paint roller storage device from the side and into the opening on one side of the double foil or foil bag.

A window 23 may be provided in the form of a transparent plastic plate inserted into a corresponding recess. This window may be located in recess 8 to permit a view of the interior of the container.

The invention is not limited in its embodiments to the above described preferred embodiment. Rather, a number of variations are conceivable which utilize the disclosed solution even for basically differently configured embodiments.

The present disclosure relates to the subject matter disclosed in German patent number P 35 42 164.9 of Nov. 26th, 1985, the entire specification of which is incorporated herein by reference.

The invention now being fully described, it will be apparent to one of ordinary skill in the art that many changes and modifications can be made thereto without departing from the spirit or scope of the invention as set forth herein.

What is claimed is:

1. A storage container for a paint roller having a handle and a paint-applying roll, said storage container comprising a housing for receiving and enclosing the paint roller therein and having a recess generally configured to the outline of the roller to receive said paint roller therein, said housing having an inside and an outside, means to provide open and closed positions for said housing, said open position permitting the insertion and removal of the paint roller, sealing means provided in said container for forming a hermetic seal around the roller when the container is in the closed position; and foil receiving means in said container generally configured to the outline of a roll of foil for receiving said roll of foil, said foil receiving means being adjacent said paint-applying roller when said roller is disposed in said container, said foil receiving means defining a further recess.

2. The container of claim 1, wherein the foil roll recess is located on the inside of the housing.

3. The container of claim 1, wherein the storage container is made of molded plastic by injection molding or deep drawing.

4. The container of claim 1, wherein the paint-applying roller recess comprises a handle-shaped portion for receiving the handle of the paint roller; and said container further comprises at least one of supporting feet and a handle, said handle and said supporting feet being molded on the outside of the housing and located in the vicinity of the portion for the handle of the paint-applying roller recess.

5. The container of claim 1, further comprising a viewing window provided in the paint roller recess.

6. The container of claim 1, wherein the housing of the paint roller storage container further comprises two parts, and an articulated connection therebetween; said two parts being pivotally movable with respect to one another by means of said articulated connection.

7. The container of claim 6, wherein the articulated connection between the two parts of the housing is hinges.

8. The container of claim 6, wherein the two parts of the housing are two half shells having an essentially symmetrical configuration and are manufactured with a single mold.

9. The container of claim 6, wherein each part of the housing is further provided with an edge; and said sealing means comprise two sealing members for forming said air-tight seal between the two parts of said housing, each said member being positioned along the edge of a respective part of said housing.

10. The container of claim 9, wherein each said sealing member is a profiled member of foamed material molded to its respective part.

11. The container of claim 9, wherein each said member for forming an air-tight seal between the two parts of said housing is a profiled rubber material; and each part of the housing has one other recess provided along the edge of said part wherein the profiled rubber material is inserted.

12. The container of claim 6, further comprising a clamp for closing the two parts of the housing.

13. The container of claim 12, wherein the clamp is one of a spring clamp and a wire bar.

14. A storage container for a paint roller having a handle and a paint-applying roll, said storage container comprising a housing for receiving and enclosing the paint roller therein and having a recess to receive said paint roller therein, said housing having an inside and an outside, and means to provide open and closed positions therefor, said open position permitting the insertion and removal of the paint roller, sealing means provided in said container for forming a hermetic seal around the roller when the container is in the closed position; and means defining a further recess serving as a receptacle for a roll of foil and being adjacent, and parallel to, the paint-applying roll when the roller is disposed in said container in combination with a roll of foil disposed in said further recess.

15. The container of claim 14 further including means secured in said housing and abutting said roll of foil to prevent unrolling of said foil.

16. A storage container for a paint roller having a handle and a paint-applying roll, said storage container comprising a housing for receiving and enclosing the paint roller therein and having a recess to receive said paint roller therein, said housing having an inside and an outside, and means to provide open and closed positions therefor, said open position permitting the insertion and removal of the paint roller, sealing means provided in said container for forming a hermetic seal around the roller when the container is in the closed position; and means defining a further recess serving as a receptacle for a roll of foil and being adjacent, and parallel to, the paint-applying roll when the roller is disposed in said container, wherein the housing of the paint roller storage container further comprises two parts, and an articulated connection therebetween; said two parts being pivotally movable with respect to one another by means of said articulated connection, wherein the paint-applying roll recess and the foil roll recess are semi-cylindrical recesses; and each part of the housing has one side in the form of a trough wherein the paint-applying roll recess and the foil roll recess are located.

17. A storage container for a paint roller having a handle and a paint-applying roll, said storage container comprising a housing for receiving and enclosing the paint roller therein and having a recess to receive said paint roller therein, said housing having an inside and an outside, and means to provide open and closed positions therefor, said open position permitting the insertion and removal of the paint roller, sealing means provided in said container for forming hermetic seal around the roller when the container is in the closed position; and means defining a further recess serving as a receptacle for a roll of foil and being adjacent, and parallel to, the paint-applying roll when the roller is disposed in said container, wherein the housing of the paint roller storage container further comprises two parts, and an articulated connection therebetween; said two parts being pivotally movable with respect to one another by means of said articulated connection, wherein one part of the housing further comprises a tear-off edge provided with serrated teeth, said edge being located adjacent to the foil roll recess and the paint-applying roll recess.

18. The container of claim 17, wherein the serrated teeth of the tear-off edge have a length of about 7 mm.

19. The container of claim 17 further comprising a supporting web for pretensioning a foil located in said foil roll recess, said supporting web being located on said part of the housing other than said one part of the housing provided with the tear-off edge and opposite said edge.

* * * * *